US010561008B2

(12) United States Patent
Mori et al.

(10) Patent No.: US 10,561,008 B2
(45) Date of Patent: Feb. 11, 2020

(54) LASER DRIVEN LAMP

(71) Applicant: USHIO DENKI KABUSHIKI KAISHA, Tokyo (JP)

(72) Inventors: Kazuyuki Mori, Tokyo (JP); Junya Asayama, Tokyo (JP); Toshio Yokota, Tokyo (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/078,251

(22) PCT Filed: Jan. 31, 2017

(86) PCT No.: PCT/JP2017/003334
§ 371 (c)(1),
(2) Date: Aug. 21, 2018

(87) PCT Pub. No.: WO2017/145662
PCT Pub. Date: Aug. 31, 2017

(65) Prior Publication Data

US 2019/0053364 A1 Feb. 14, 2019

(30) Foreign Application Priority Data

Feb. 23, 2016 (JP) ..... 2016-031798

(51) Int. Cl.
*H05G 2/00* (2006.01)
*H01J 61/30* (2006.01)
(Continued)

(52) U.S. Cl.
CPC ..... *H05G 2/008* (2013.01); *H01J 61/025* (2013.01); *H01J 61/30* (2013.01); *H01J 65/04* (2013.01)

(58) Field of Classification Search
CPC ..... H05G 2/008; H01J 61/025; H01J 61/30; H01J 65/04
(Continued)

(56) References Cited

U.S. PATENT DOCUMENTS

2007/0228300 A1* 10/2007 Smith ..... B82Y 10/00 250/504 R
2010/0164347 A1 7/2010 Yasuda et al.
(Continued)

FOREIGN PATENT DOCUMENTS

EP 2 202 780 A2 6/2010
JP H03-258481 A 11/1991
(Continued)

OTHER PUBLICATIONS

International Search Report issued in PCT/JP2017/003334; dated Apr. 18, 2017.
(Continued)

*Primary Examiner* — Michael Maskell
(74) *Attorney, Agent, or Firm* — Studebaker & Brackett PC

(57) ABSTRACT

The laser driven lamp comprising: a main body having a columnar shape; a concave reflecting portion formed at a front side of the main body, the concave reflecting portion having a focal point at which the laser beam converges; a light exit window provided in front of the concave reflecting portion; a laser beam passing hole formed at a center of the main body, the laser beam passing hole penetrating the main body in an optical axial direction of the lamp; and a light entrance window provided at a rear side of the main body, the laser beam being incident to the light entrance window, the main body, the light exit window and the light entrance window constituting in combination a closed space, and the light emitting gas being enclosed in the closed space.

7 Claims, 7 Drawing Sheets

(51) Int. Cl.
*H01J 65/04* (2006.01)
*H01J 61/02* (2006.01)

(58) Field of Classification Search
USPC ..... 250/430, 504 R
See application file for complete search history.

(56) References Cited

U.S. PATENT DOCUMENTS

| | | | | |
|---|---|---|---|---|
| 2015/0332908 | A1* | 11/2015 | Blondia | H01J 61/16 313/111 |
| 2016/0351383 | A1* | 12/2016 | Blondia | H01J 61/16 |

FOREIGN PATENT DOCUMENTS

| | | | |
|---|---|---|---|
| JP | 2010-170112 | A | 8/2010 |
| JP | 2016-513351 | A | 5/2016 |
| WO | 2014/130836 | A1 | 8/2014 |
| WO | 2015/175760 | A1 | 11/2015 |

OTHER PUBLICATIONS

An Office Action; mailed by the Japanese Patent Office dated May 22, 2018, which corresponds to Japanese Patent Application No. 2016-096667.
An Office Action; mailed by the Japanese Patent Office dated May 29, 2018, which corresponds to Japanese Patent Application No. 2016-176110.
An Office Action; mailed by the Japanese Patent Office dated Jul. 25, 2018, which corresponds to Japanese Patent Application No. 2016-176110.

* cited by examiner

LASER DRIVEN LAMP

TECHNICAL FIELD

The present invention relates to a laser driven lamp. More particularly, the present invention relates to a laser driven lamp in which a lamp main body and a reflection mirror are integrated.

BACKGROUND ART

In recent years, an ultra violet light source that receives a large amount of input electric power has been widely used in a manufacturing process of a to-be-processed product such as semiconductors, liquid crystal substrates, a color filters and the like.

It is a certain type of a high pressure discharge lamp capable of generating an arc discharge between electrodes in an arc tube enclosing mercury vapor or noble gas that is most frequently used as this type of the ultra violet light source.

In the meantime, in the above mentioned manufacturing process, it is required to reduce the processing time more and more. For this reason, the high pressure discharge lamp to be used in the above mentioned application is required to improve the radiance thereof more and more. Thus, it is required to increase the input electric power in order to improve the radiance of the high pressure discharge lamp.

Nevertheless, when the input electric power to the lamp is simply increased, it leads to a larger load to the electrodes of the discharge lamp. As a result, it is likely to entail a possible problem in which a lamp becomes blacken and becomes short-lived due to the evaporation of an electron radioactive substance from the electrodes.

In order to cope with the above mentioned problem in the high pressure discharge lamp, a certain technique has been proposed in which an energy from a laser is input into a discharge space to excite a light emitting gas so as to obtain the ultra violet light radiation (or irradiance), which is exemplarily disclosed in the Patent Literature 1 (Laid-open Publication of Japanese Patent Application No. 2010-170122 A).

This type of light source is referred to as a Laser Produced Plasma (LPP) light source, or alternatively, Laser Sustained Plasma (LSP).

According to prior art exemplarily disclosed in the Patent Literature 1 (Laid-open Publication of Japanese Patent Application No. 2010-170122 A), a plasma generating vessel 30 includes a light emitting part 31, which is made from quartz glass, and a sealing part 32. The light emitting part 31 encloses, for example, mercury and xenon gases as a light emitting substance.

In the example of the Patent Literature 1, the plasma generating vessel 30 is implemented as an electrodeless plasma generating vessel. The plasma generating vessel 30 is disposed at one of focal points F1 of an ellipsoidal reflector mirror 40.

On the other hand, a laser beam generator 50 is disposed in front of the ellipsoidal reflector mirror 40. The laser beam generator 50 emits the laser beam of, for example, pulsed laser beam or a Continuous Wave (CW) laser beam and the emitted laser beam is introduced into the plasma generating vessel 30.

The laser beam emitted from the laser beam generator 50 proceeds through a window part 61 of a plane (planar) mirror 60, and condensed by a light condensing lens 70, which is disposed between the window part 61 and the plasma generating vessel 30, such that the plasma generating vessel 30 is irradiated with the condensed beam. By condensing the laser beam, it makes it possible to increase the energy density at the focal point F1. Thus, it makes it possible to excite the light emitting substance so as to generate the radiation (radiated) light. The resulting radiation light from the plasma generating vessel 30 is reflected by the ellipsoidal reflector mirror 40 and further reflected by the plane mirror 60 so as to proceed toward an object to be irradiated.

In the above mentioned conventional LPP (or LSP) lamp, the quartz glass is employed as a material of the plasma generating vessel. However, the plasma generating vessel employing the quartz glass may entail a problem in which the plasma generating vessel tends to undergo the distortion, which is caused by the ultra violet light or the vacuum ultra violet light, because the plasma generating vessel is irradiated with the high power ultra violet light (UV light) and the high power vacuum ultra violet light (VUV light) from the plasma.

As the above mentioned distortion caused by the ultra violet light or the vacuum ultra violet light accumulates, the accumulated distortion caused by the ultra violet light or the vacuum ultra violet light may then cause a glass surface to crack. It is concerned that the cracked portion may trigger the lamp to be damaged or even corrupted.

In order to avoid the above mentioned defect, by employing, for the plasma generating vessel, a crystalline material such as crystal (crystallized quartz) or sapphire instead, it may be possible to reduce the distortion caused by the ultra violet light or the vacuum ultra violet light. However, it would be extremely difficult in terms of manufacturing to mold the crystalline material into a vessel having a cylindrical or spherical shape. Because of the difficulty in the manufacturing process, therefore, use of the crystalline material is not practical.

LISTING OF REFERENCES

Patent Literature

PATENT LITERATURE 1: Laid-open Publication of Japanese Patent Application No. 2010-170112 A

SUMMARY OF THE INVENTION

Problems to Be Solved By the Invention

Taking the above mentioned circumstances into consideration, the present invention has been made in order to solve the above mentioned problems and an object thereof is to provide a lamp structure that is capable of preventing the distortion caused by the ultra violet light or the vacuum ultra violet light from occurring in the plasma generating vessel even when being irradiated with the high power ultra violet light or the high power vacuum ultra violet light from the plasma, in the laser driven lamp that encloses light emitting gas, receives a converging laser beam and generates plasma from the laser beam.

Solution to Problems

In order to solve the above mentioned problems, according to one aspect of a laser driven lamp of the present invention, there is provided a laser driven lamp, comprising: a main body having a columnar shape; a concave reflecting portion formed at a front side of the main body, the concave reflecting portion having a focal point at which the laser beam converges; a light exit window provided in front of the concave reflecting portion; a laser beam passing hole formed at a center of the main body, the laser beam passing hole penetrating the main body in an optical axial direction of the lamp; and a light entrance window provided at a rear side of the main body, the laser beam being incident to the light entrance window. In the laser driven lamp, the main body, the light exit window and the light entrance window constitute in combination a closed space, and the light emitting gas is enclosed in the closed space.

Furthermore, in the above mentioned laser driven lamp, the light exit window may be provided with a reflective part formed at a center part of the light exit window and configured to reflect the laser beam.

Yet furthermore, in the above mentioned laser driven lamp, the main body may be provided with a tapered part at a light incident side of the laser beam passing hole in the main body.

Yet furthermore, the above mentioned laser driven lamp may further comprise a gas release pipe attached to the lamp, the gas release pipe communicates with the closed space in the main body.

Yet furthermore, in the above mentioned laser driven lamp, the window attaching cylindrical body is made from a metal, and the gas release pipe is attached to the window attaching cylindrical body.

Yet furthermore, in the above mentioned laser driven lamp, the main body is made of ceramic, and the gas release pipe is attached to the main body.

Yet furthermore, in the above mentioned laser driven lamp, the light entrance window is attached to the main body with a metallic block being interposed between the light entrance window and the main body, and the gas release pipe is attached to the metallic block.

Yet furthermore, in the above mentioned laser driven lamp, the light entering window and the light emitting window may be attached to the trunk portion through a window attaching cylindrical body, and a pressure relief portion may be provided at either the window attaching cylindrical body or the exhaust pipe.

Yet furthermore, in the above mentioned laser driven lamp, the light entrance window and the light exit window are attached to the main body through window attaching cylindrical bodies, respectively, and a pressure relief part is provided at either the window attaching cylindrical body or the gas release pipe.

Yet furthermore, in the above mentioned laser driven lamp, the pressure relief part is constituted by forming a concave at either the window attaching cylindrical body or the gas release pipe so as to allow the pressure relief part to be thin-walled.

Yet furthermore, in the above mentioned laser driven lamp, the light entrance window is provided with an incident surface configured to be inclined with respect to an optical path of the laser beam.

Advantageous Effect of the Invention

According to a laser driven lamp of the present invention, since a laser driven lamp is constituted with a main body having a columnar shape, and a light exit window and a light entrance window disposed at front and rear ends, respectively, it makes it possible to employ a constituent material other than quartz glass, such as ceramics or metal or the like, for constituting the main body, and also to employ a crystalline material having the light permeability for constituting the light entrance window or the light exit window. As a result, it makes it possible to effectively prevent the distortion caused by the ultra violet light or the vacuum ultra violet light from occurring even when being irradiated with high power ultra violet light and vacuum ultra violet light from the plasma so as to accomplish a laser driven lamp having a higher output power with a longer operating life.

DESCRIPTION OF EMBODIMENTS

Figure 1:
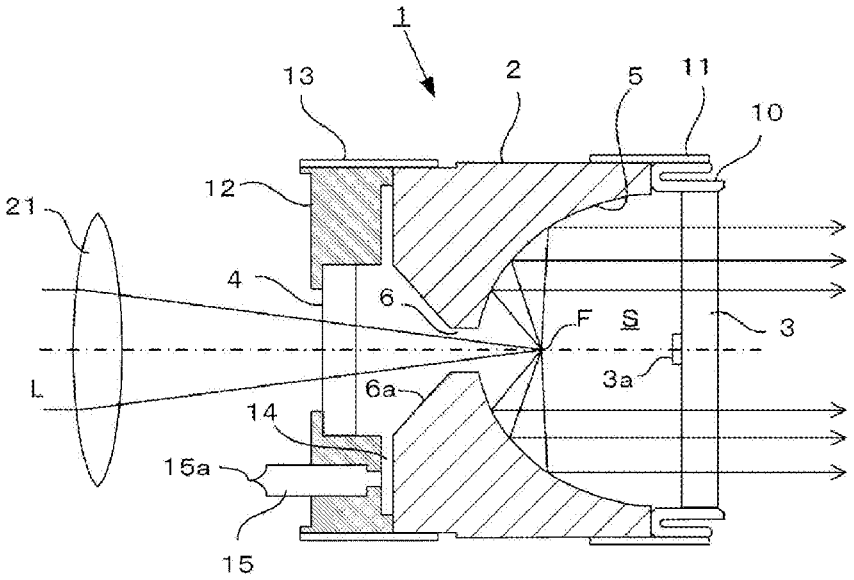
FIG. 1 is a cross-sectional view showing an exemplary laser driven lamp according to a first embodiment of the present invention.

Hereinafter, embodiments of the present invention will be described with reference to the accompanying drawings in detail. FIG. 1 illustrates a first embodiment of the present invention. Referring to FIG. 1, a laser driven lamp 1 includes a main body 2 having a columnar shape, and a light exit window 3 and a light entrance window 4 disposed at front and rear ends (faces) of the main body 2, respectively. The main body 2 is made of a ceramic material such as polycrystal alumina ($Al_2O_3$).

Also, the main body 2 is provided with a concave reflecting portion 5 at a front side of the main body 2. The main body 2 is also provided with a laser beam passing hole 6 bored (formed) at the center of the main body 2, which passes through (penetrates) the main body in an optical axial direction of the lamp.

The laser beam passing hole 6 is provided with a tapered part 6*a* formed by chamfering (corner-cutting) a rear end side, in other words, an light incident side, of the laser beam passing hole 6. The tapered part 6*a* is intended to prevent the conversing (condensed) laser beam from being rejected (bounced back) and interrupted (blocked) at the light incident side of the laser beam passing hole 6, when the conversing laser beam enters and is guided into the laser beam passing hole 6 through the light entrance window 4.

The concave reflection portion 5 may be shaped into a parabolic shape or an ellipsoidal shape, and exemplarily described as a reflection portion having the parabolic shape. The concave reflection portion 5 is formed by a metal evaporated (vapor-deposited) film in which aluminum or the like is vapor deposited onto a concave portion of the main body 2, or otherwise by a dielectric multilayer film.

A light exit window 3 disposed in front of the concave reflection portion 5 has an ultra violet light permeability, while a light entrance window 4 disposed at a rear end (side) of the concave reflection portion 5 has a laser beam permeability, both of which are made of crystalline materials such as crystal quartz or sapphire or the like. Outer circumference surfaces of the light exit window 3 and the light entrance window 6 are both metallized by coating with metal consisting of, for example, a mixture of molybdenum and manganese, respectively.

Likewise, front and rear ends of the outer circumference of the main body 2 are metallized as well as the light exit window 3 or the light entrance window 4, respectively.

Then the light exit window 3, of which outer circumferential surface is metallized, is jointed to an elastic ring member 10 made from a metal by brazing using silver solder or the like.

On the other hand, a window attaching cylindrical body 11 made from a metal is jointed to a metallized front end of the main body 2 by brazing. In addition, the ring member 10 and the window attaching cylindrical body 11 are welded and bonded to each other by, for example, a tungsten inert gas arc (TIG) welding or laser welding or the like. As a result, the light exit window 3 is firmly attached to the front face side of the main body 2.

On the other hand, the light entrance window 4, of which outer circumferential surface is metallized, is jointed to the metallic block 12 by brazing, and the window attaching cylindrical body 13 made from a metal is jointed to the metallized rear end of the main body 2 by brazing. In addition, the metallic block 12 and the window attaching cylindrical body 13 are welded and bonded to each other by, for example, the TIG welding or the laser welding or the like. As a result, the light entrance window 4 is firmly attached to the rear face side of the main body 2.

The main body 2, the light exit window 3, and the light entrance window 4, all of which are assembled in the above described manner, constitute a plasma vessel. A closed (sealed) space S is formed inside the plasma vessel, and noble gas, such as xenon gas, krypton gas, argon gas or the like, and/or mercury gas or the like is enclosed inside the closed space S as light emitting (luminescent) gas depending on the desired emission wavelength.

Between the main body 2 and the metallic block 12, a gap 14 is formed and the gap 14 communicates with the closed space S.

On the other hand, a gas release pipe 15 is fixed to the metallic block 12 by brazing. The gas release pipe 15 communicates with the gap 14, and further communicates with the closed space S through the gap 14. After vacuum drawing the closed space S through the gas release pipe 15, the light emitting gas is enclosed inside the closed space S, and after then an end part 15*a* of the gas release pipe 15 is pressurized and cut so as to seal the closed space S.

Furthermore, the light exit window 3 may be provided with a laser beam reflective part 3*a* at a center portion of the light exit window 3. Although the laser beam is mostly absorbed by the plasma generated from the light emitting gas when the light emitting gas includes mercury, in some cases, the laser beam incidentally arrives at the light exit window 3 as the laser beam absorptivity by the plasma is lowered when the light emitting gas includes xenon or the like. In this case, by providing the laser beam reflective part 3*a* on the light exit window 3, it makes it possible to prevent the laser beam from radiating to the outside.

The laser beam L from the laser beam generator, which is not shown in the drawings, is condensed (converges) by the condenser lens 21 and then introduced into the laser driven lamp 1 according to the present embodiment through the light entrance window 4. At this moment, the light condensing spot of the laser beam L is positioned at the focal point F of the concave reflection portion 5. The plasma, which is generated at the focal point position F by the laser beam, excites the light emitting gas to emit the ultra violet light, and the ultra violet light (excitation light) EL is reflected by the concave reflection portion 5, and then emits forwardly through the light exit window 3.

Figure 2:
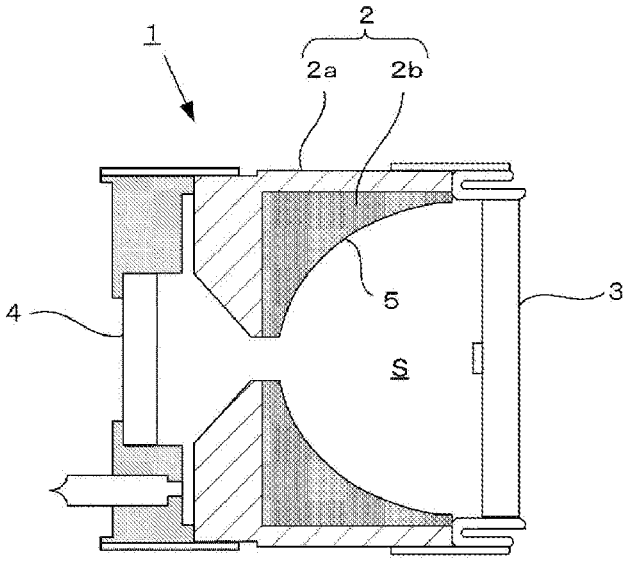
FIG. 2 is a cross-sectional view showing an exemplary laser driven lamp according to a second embodiment of the present invention.

Although the first embodiment illustrated in FIG. 1 shows the main body 2 entirely constituted with ceramics, FIG. 2 illustrates a second embodiment in which the main body 2 includes a main body base part 2*a* made of ceramics and a reflection portion forming part 2*b* made from a metal. The reflection portion forming part 2*b* is incorporated into the main body base part 2*a*. The concave reflection portion 5 is formed on the reflection portion forming part 2*b*. The reflective portion forming part 2*b* may be prepared as a shaved-out part made from aluminum and the reflecting surface thereof is manufactured by cutting. By doing this, it makes it possible to form a mechanically and optically advanced reflecting surface.

Figure 3:
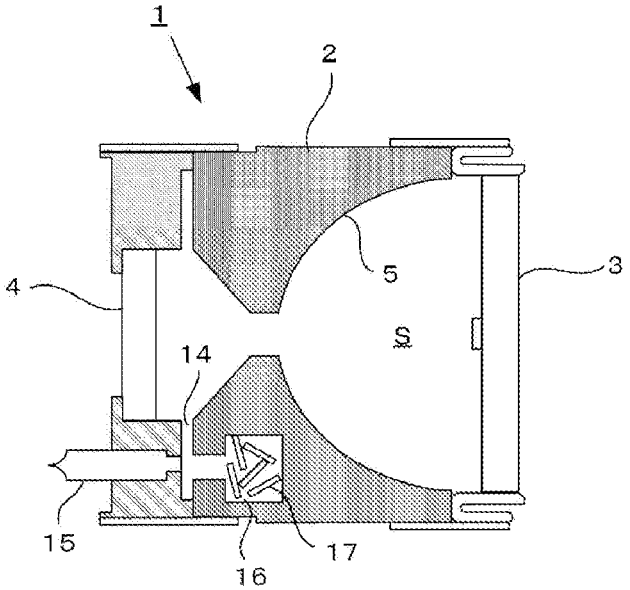
FIG. 3 is a cross-sectional view showing an exemplary laser driven lamp according to a third embodiment of the present invention.

FIG. 3 further illustrates a third embodiment of the present invention in which an entire main body 2 is made of the metallic member such as aluminum or the like. With the main body 2 being so configured, it makes it possible to enhance the thermal conduction of the main body 2 and also to improve the degradation characteristic of the reflection surface. A dielectric multilayer film may be applied to the reflecting surface.

In the meantime, as described above, when the entire main body 2 is made from a metal, gas impurities emitted from the main body 2 increases upon turning on (lightening) the lamp. To cope with this, a getter accommodating space 16 may be formed in the main body 2 to accommodate a getter material 17 (e.g., for preventing lamp blackening), which may communicate with the closed space S through the gap 14.

Concrete example of the dimensions according to the first embodiment shown in FIG. 1 will be described below.

Main Body (2): made from polycrystalline alumina ($Al_2O_3$); entire length of 22 mm; and outer diameter of 32 mm Enclosed Gas: xenon gas 2.0 MPa (at 25 degrees Celsius)

Light Entrance Window Member (4): made from sapphire; outer diameter of 15 mm; and thickness of 3 mm Light Exit Window Member (3): made from sapphire; outer diameter 32 mm; and thickness of 3 mm Ring Member (10): made from kovar Window Attaching Cylindrical Body (11,13): made from kovar; outer diameter of 33 mm; and wall thickness of 0.5 mm Gas Release Pipe (15): made from nickel; and outer diameter of 3 mm Metallic Block (12): made from kovar; and outer diameter of 32 mm In the above described first to third embodiments shown in FIGS. 1 to 3, respectively, the light entrance window 4 is attached to the main body 2 with the metallic block 12 interposing therebetween. Nevertheless, without employing the metallic block 12, the light entrance window 3 may have a similar attaching structure to those attaching the light exit window 3 to the main body 2.

Figure 4:
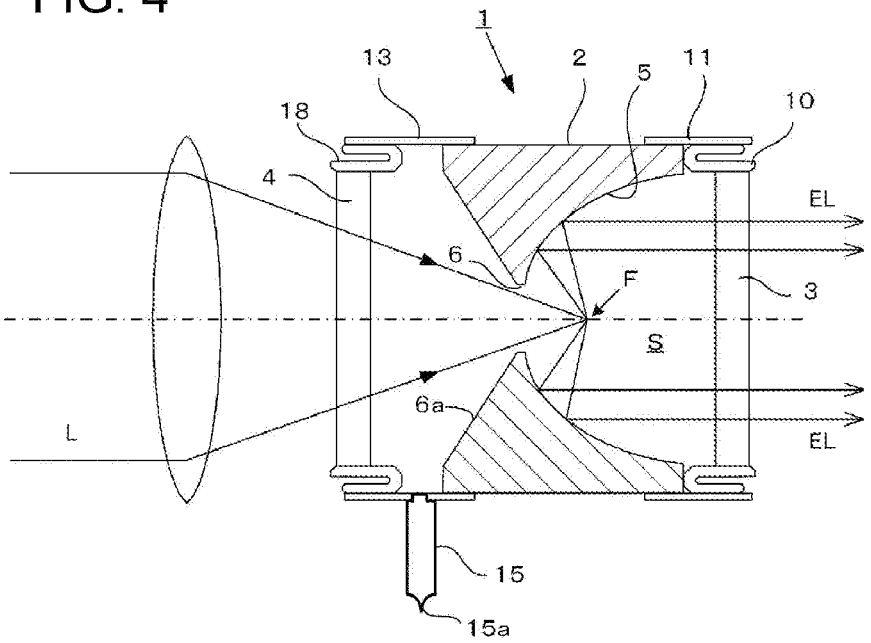
FIG. 4 is a cross-sectional view showing an exemplary laser driven lamp according to a fourth embodiment of the present invention.

In other words, in the fourth embodiment shown in FIG. 4, an elastic ring member 18 made from a metal is provided to be jointed to the light entrance window 4 by brazing. The ring member 18 is welded and jointed to the window attaching cylindrical body 13 made from a metal, which is jointed to the main body 2. With the ring member 18 so configured, the light entrance window 4 is resultantly firmly attached to the main body 2.

As described above, by employing the attaching structure without the metallic block interposing (lying) between the light entrance window 4 and the main body 2, it makes it possible to allow the incident solid angle of the laser beam L entered from the light entrance window 4 to be greater. As a result, it makes it possible to enhance the energy density input to the plasma, which is generated in the closed space S of the laser driven lamp 1, so as to obtain the plasma with higher density.

When employing the above mentioned attaching structure, the above described gas release pipe 15 can be attached to the window attaching cylindrical body 13 of the light entrance window 4 by brazing so as to communicate with the closed space S.

It should be noted that other configuration is similar to those in the first embodiment shown in FIG. 1.

Figure 5:
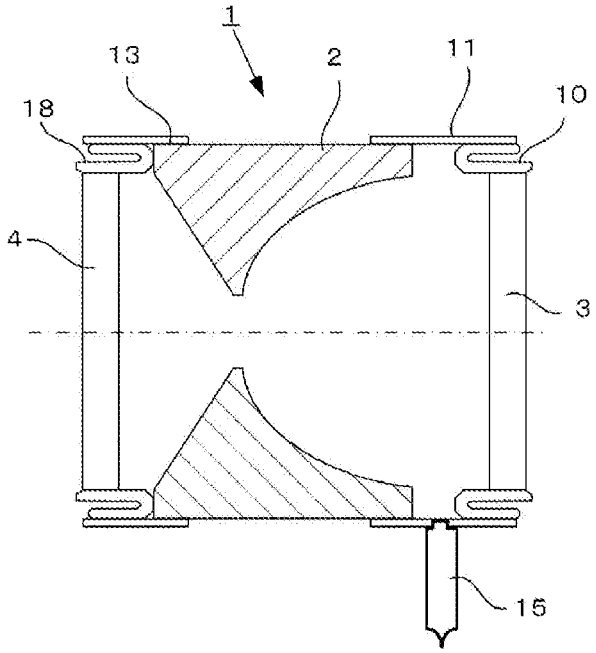
FIG. 5 is a cross-sectional view showing an exemplary laser driven lamp according to a fifth embodiment of the present invention.

FIG. 5 illustrates a fifth embodiment of the present invention in which the gas release pipe 15 is attached to the window attaching cylindrical body 11 of the light exit window 3. Other configuration is similar to those in the above mentioned fourth embodiment.

Figure 6:
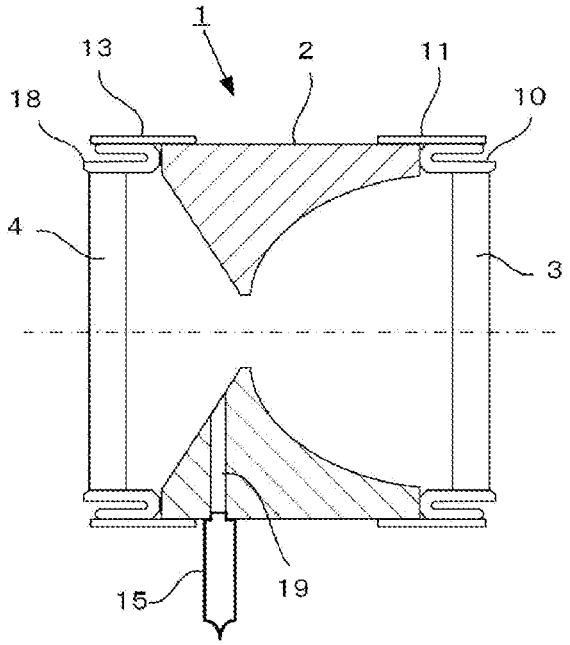
FIG. 6 is a cross-sectional view showing an exemplary laser driven lamp according to a sixth embodiment of the present invention.

FIG. 6 illustrates a sixth embodiment of the present invention in which the gas release pipe 15 is attached to the main body 2 and a communicating (continuous) hole 19, which allows the gas release pipe 15 to communicate with the closed space S, is formed in the main body 2. It should be noted that, when attaching the gas release pipe 15, it is possible to metallize a prescribed attaching region of the main body 2 and to attach the gas release pipe 15 thereto by brazing. Other configuration is similar to those in the above mentioned fourth embodiment shown in FIG. 4.

In the above mentioned embodiments shown in FIGS. 4 to 6, respectively, the closed space S is vacuum drawn and the gas release pipe 15, which is to enclose the light emitting gas, is then attached to either the main body 2 or the window attaching cylindrical bodies 11 and 13. For this reason, as the laser beam L entering from the light entrance window 4 is not shielded by the gas release pipe 15, it makes it possible to allow the incident solid angle to be greater at its maximum without being constrained by the gas release pipe 15. As a result, it makes it possible to further enhance the energy density input into the plasma.

In the meantime, in the above described laser driven lamp, when any defect or error occurs in the laser source due to some sort of reasons, the laser beam generator may become out of control. In this case, the output power of the laser beam input into the plasma vessel of the laser driven lamp is likely to increase.

As another example, when employing a certain system in which an optical output from the laser driven lamp is measured by a detector and the laser driven lamp is feed-back-controlled, if the detector is deteriorated, the light intensity (light amount) is likely to be underestimated. In this case, the laser beam generator is likely to increase the output power of the laser beam.

Under those circumstances, as excessive energy is supplied to the inside of the closed space of the laser driven lamp, the temperature inside the closed space increases and the pressure inside the closed space increases as well.

As yet another example, when the plasma temperature exceptionally increases due to any defect or error occurred in a cooling system, similarly the pressure inside the closed space increases.

When the pressure inside the closed space continues to increase beyond the limit of the withstand (proof) pressure, the laser driven lamp may explode.

The gas inside the closed space is under the high pressure and high temperature condition, for example, 20 atmospheric pressure when enclosed, and 40 to 60 atmospheric pressure during lightening. Thus, when the laser driven lamp explodes, broken pieces or fragments thereof scatter in every direction at considerable speed and with considerable kinetic energy. The broken pieces or fragments may collide against the lens arranged at the front side of the laser driven lamp or the reflector mirror arranged at the circumference so as to damage those optical instruments.

Inter alia, when using the vacuum ultra violet light, expensive magnesium fluoride (MgF) or calcium fluoride (CaF2) is required to be employed for such lens or window material or the like. Nevertheless, those expensive members may be damaged or even broken in an instant, which is problematic.

In order to solve the above mentioned problem, according to another embodiment of the present invention, the laser driven lamp is provided with a pressure relief part. FIGS. 7 to 11 illustrate such embodiment in which the pressure relief part is provided to relieve and release the pressure at a prescribed location when the pressure inside the closed space extremely or exceptionally increases. As a result, it makes it possible to reduce the damages in other components constituting the laser driven lamp or the circumferential optical system.

Figure 7:
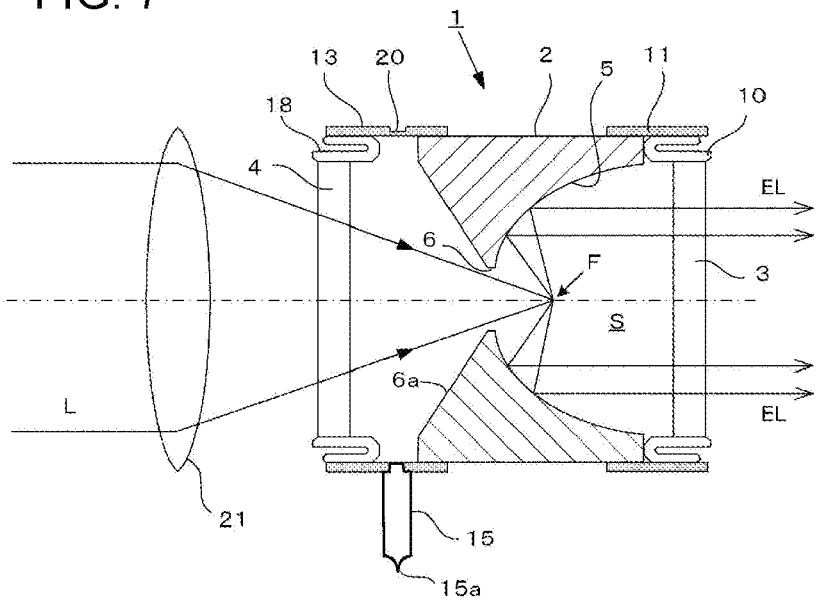
FIG. 7 is a cross-sectional view showing an exemplary laser driven lamp according to a seventh embodiment of the present invention.

In a seventh embodiment shown in FIG. 7, the window attaching cylindrical body 13, to which the light entrance window 4 is attached, is provided with a pressure relief part 20. The pressure relief part 20 is formed by forming a concave (or recess) on an outer surface of the window attaching cylindrical body 13 so as to allow the pressure relief part 20 to be thin-walled.

Figure 8A:
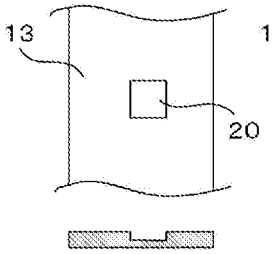
FIGS. 8A to 8F are views showing an exemplary pressure relief part according to various embodiments of the present invention.
Figure 8B:
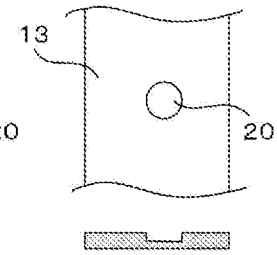
Figure 8C:
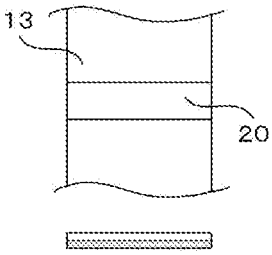

FIGS. 8A to 8F illustrate various embodiments of the concave (that is, pressure relief part) 20. FIG. 8A shows a concave having a squared shape, FIG. 8B shows another concave having a circular shape, and FIG. 8C shows yet another concave having a slit shape travelling across the window attaching cylindrical body 13.

Figure 8D:
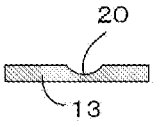
Figure 8E:
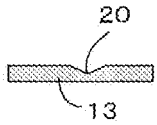

In addition, the cross sectional shape of the concave may be also a hemisphere shape as shown in FIG. 8D, or a V-shaped shape (conical shape) as shown in FIG. 8E other than the squared shape.

Figure 8F:
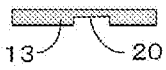

Also, as shown in FIG. 8F, the concave 20 may be formed on an inner surface side of the window attaching cylindrical body 13.

Figure 9A:
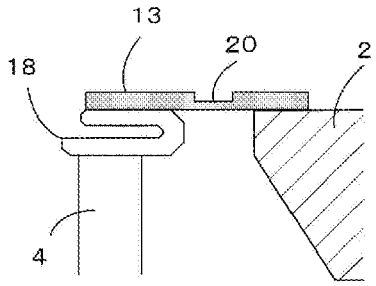
FIGS. 9A and 9B are views showing a functional operation of the pressure relief part.
Figure 9B:
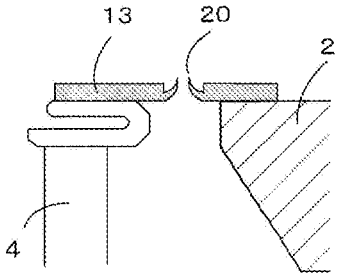

FIGS. 9A and 9B illustrate operational states of the pressure relief part 20. In the case of a normal pressure condition, the pressure relief part 20 is under the steady condition, as shown in FIG. 9A. On the other hand, when the pressure inside the closed space increases due to the defect or error, the pressure relief part 20, which is thin-walled, expands and then brakes so as to relieve the pressure, as shown in FIG. 9B.

In the seventh embodiment shown in FIG. 7, the pressure relief part 20 is provided at the window attaching cylindrical body 13 of the light entrance window 4. Nevertheless, alternatively, as shown in an eighth embodiment shown in FIG. 10, the pressure relief part 20 may be provided at the widow attaching cylindrical body 11 of the light exit window 3.

Also, in those embodiments, a certain structure is described in which the gas release pipe 15 is attached to the window attaching cylindrical body 11 or 13 in which the pressure relief part 20 is formed. Nevertheless, alternatively, another structure may be instead employed in which the pressure relief part 20 and the gas release pipe 15 may be attached to different window attaching cylindrical bodies 11 and 13, respectively.

Figure 11:
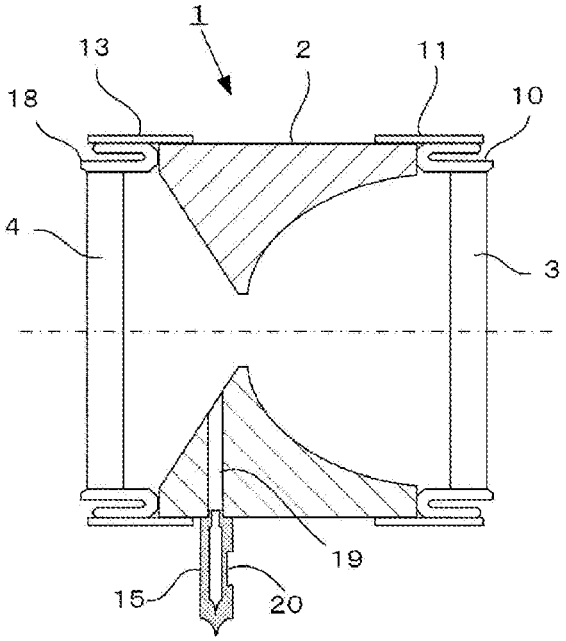
FIG. 11 is a cross-sectional view showing an exemplary laser driven lamp according to a ninth embodiment of the present invention.

Yet furthermore, FIG. 11 illustrates a ninth embodiment in which the pressure relief part 20 is formed at the gas release pipe 15. In other words, according to the ninth embodiment, the gas release pipe 15 is attached to the main body portion 2, and the communicating hole 19, which is to allow the gas release pipe 15 to communicate with the closed space S, is formed in the main body 2.

It should be noted that, when attaching the gas release pipe 15, it is possible to metallize a prescribed attaching region in the main body 2 and to attach the gas release pipe 15 thereto by brazing.

According to the ninth embodiment, the pressure relief part 20, which is thin-walled, is formed at the above mentioned gas release pipe 15.

Figure 10:
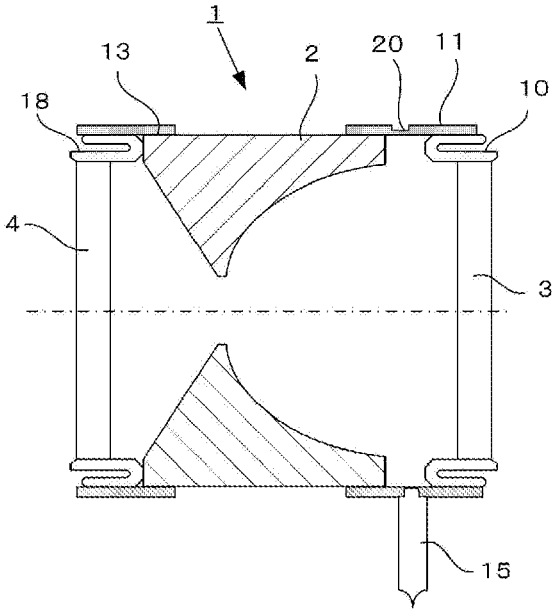
FIG. 10 is a cross-sectional view showing an exemplary laser driven lamp according to an eighth embodiment of the present invention.

Furthermore, the gas release pipe 15, in which the pressure relief part 20 is formed, may be attached to the window attaching cylindrical body 13 of the light entrance window 4, as shown in FIG. 7, or alternatively attached to the window attaching cylindrical body 11 of the light exit window 3, as shown in FIG. 10.

Yet furthermore, the pressure relief part 20 may be formed at the gas release pipe 15, which is attached to the metallic block 12 to which the light entrance window 4 is attached, as described in the first embodiment shown in FIG. 1.

As described above, by providing the pressure relief part in the laser driven lamp, even when inside the closed space becomes under the exceptionally high pressure condition, since the pressure relief part is intentionally broken, it makes it possible to relieve the high pressure at a prescribed position, which is specified in advance, and to prevent other components constituting the laser driven lamp from being damaged. Also, the circumferential optical system is unlikely to be damaged.

In the meantime, as shown in FIG. 1, the laser beam L from the laser beam generator, which is not shown in the drawings, enters into the closed space S of the laser driven lamp 1 from the light entrance window 4. At this moment, in some cases, an extremely small part of the laser beam is reflected due to the difference in the refractive indices between the light entrance window 4 and surrounding atmosphere (for example, atmospheric air).

The part of the reflected laser beam may unintentionally proceed toward the laser beam generator along an opposite path to the light incident path from the light entrance window 4.

The reflected laser beam returned back to the laser beam generator may cause the laser medium in the laser beam generator to be excessively overheated. As a result, in some cases, the laser beam generator may be ultimately damaged or broken, which is problematic.

Figure 12:
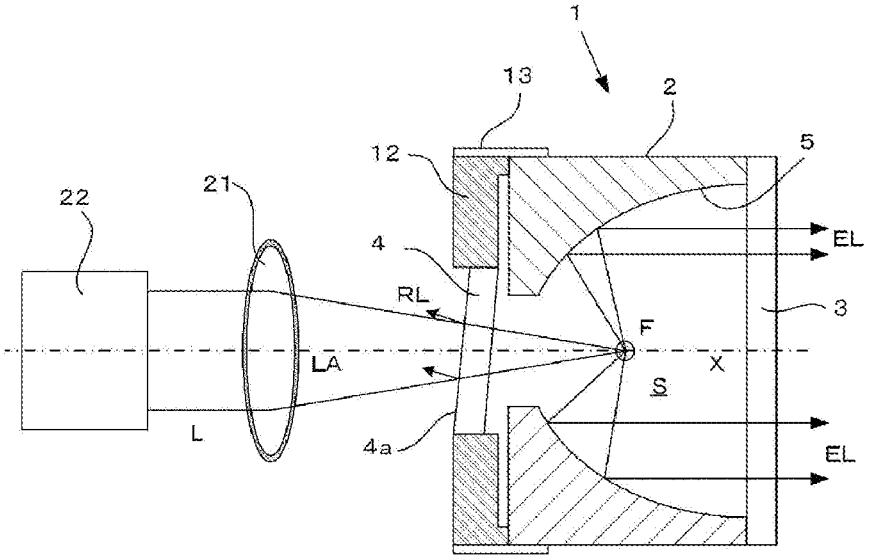
FIG. 12 is a cross-sectional view showing an exemplary laser driven lamp according to a tenth embodiment of the present invention.
Figure 13:
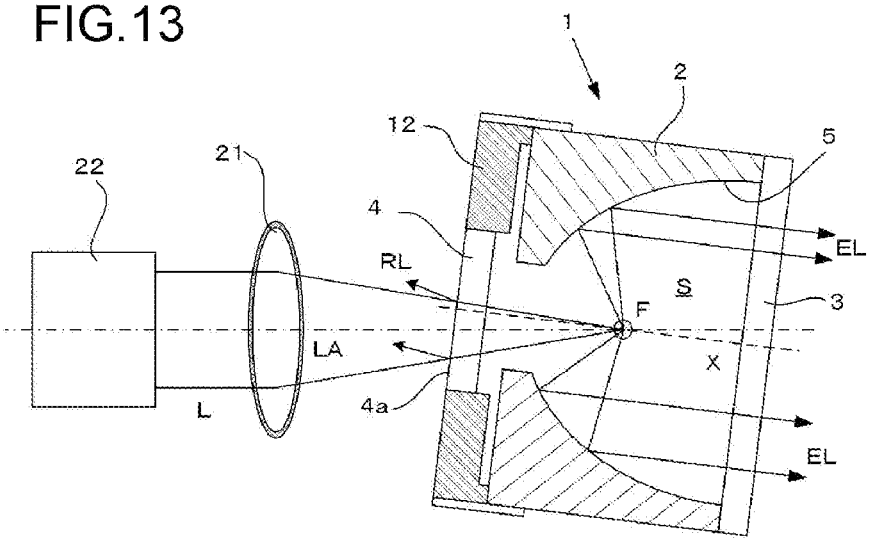
FIG. 13 is a cross-sectional view showing an exemplary laser driven lamp according to an eleventh embodiment of the present invention.
Figure 14:
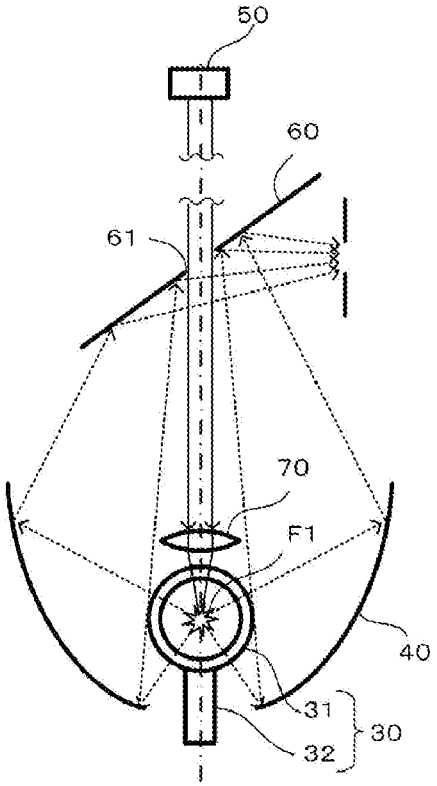
FIG.14 (PRIOR ART)
FIG. 14 is a schematic view showing a conventional high pressure discharge lamp.

In order to solve the above problem, FIGS. 12 and 13 illustrate other embodiments, respectively, in which a light incident surface of the light entrance window in the laser driven lamp is inclined with respect to the optical path of the laser beam. By doing this, it makes it possible to prevent the laser beam reflected at the light entrance window from returning back to the laser beam generator.

FIG. 12 illustrates a tenth embodiment of the present invention. According to the tenth embodiment, the light entrance window 4 of the laser driven lamp 1 is configured to be inclined with respect to the optical path (optical axis) LA of the laser beam L, and a light incident surface 4*a* is inclined with respect to the optical path LA.

On the other hand, a rotation center axis X of the concave reflection portion 5 of the laser driven lamp 1 coincides with the optical axis LA of the laser beam L from the laser beam generator 22 and the condenser lens 21. The laser beam L from the laser beam generator 22 enters into the laser driven lamp 1 from the light entrance window 4 of the laser driven lamp 1, while being condensed (converged) by the condenser means 21, and the condensed (converged) at the focal point position F of the concave reflection portion 5.

By doing this, the plasma is generated in the closed space S mostly around the focal point position F. The excitation light EL generated by exciting the light emitting gas is reflected by the concave reflection portion 5 and then emits outside from the light exit window 3.

In the above mentioned configuration, when the laser beam L from the laser beam generator 22 enters into the light entrance window 4, the light incident surface 4*a* of the light entrance window 4 is inclined with respect to the optical path LA of the laser beam L. For this reason, the reflected light RL, which is reflected by the light incident surface 4*a*, is reflected in the direction different from the optical path of the laser beam L. As a result, the reflected light RL is prevented from returning back to and entering into the laser beam generator 22.

The above mentioned tenth embodiment describes an example in which the optical axis LA of the laser beam L from the laser beam generator 22 coincides with the rotation center axis X of the concave reflection portion 5 of the laser driven lamp 1, and the light incident surface 4*a* of the light entrance window 4 is inclined with respect to the optical axis LA of the laser beam L. Nevertheless, alternatively, the rotation center axis X of the concave reflection portion 5 may be angled with respect to the optical axis LA of the laser beam L.

FIG. 13 illustrates an eleventh embodiment in which the rotation center axis X of the concave reflection portion 5 of the main body 2 in the laser driven lamp 1 is inclined with having a certain angle with respect to the optical axis LA of the laser beam L from the laser beam generator 22. At this moment, the inclination of the rotation center axis X with respect to the optical axis LA can be achieved by rotationally moving (revolving) the laser driven lamp 1 about the focal point position F (light condensing position) on the optical axis LA of the laser beam L.

Furthermore, the light entrance window 4 is attached to the main body 2 such that the light incident surface 4*a* thereof orthogonally intersects with the rotation center axis X of the concave reflection portion 5. By doing this, the light incident surface 4*a* of the light entrance window 4 becomes to be inclined with respect to the optical axis LA of the laser beam L.

In the above mentioned configurations, the laser beam L from the laser beam generator 22 enters into the laser driven lamp 1 from the light incident surface 4*a* of the light entrance window 4. In this case, also, the reflected light RL generated at this moment is prevented from proceeding toward the laser beam generator 22, which is similar to the above mentioned tenth embodiment. Then, the laser beam L is condensed (converges) at the focal point position F of the concave reflection portion 5 in the laser driven lamp 1 so as to generate the plasma. The excitation light EL then generated by the plasma is reflected by the concave reflection portion 5 and then emits outside from the light exit window 3 along the rotation center axis X of the concave reflection portion 5 with having a certain angle with respect to the optical axis LA of the laser beam L.

As described above, the light incident surface of the light entrance window of the laser driven lamp is inclined with respect to the optical path of the laser beam from the laser beam generator. For this reason, the laser light reflected by the light incident surface travels in the direction different from the optical path of the incident laser beam. Thus, the reflected laser beam (light) is prevented from returning back to and entering into the laser beam generator. As a result, it makes it possible to prevent components in the laser beam generator such as the laser medium from being damaged.

As described above, according to the laser driven lamp of the present embodiments, the plasma generating vessel is constituted by providing the light exit window and the light entrance window at the front and rear ends (sides) of the main body having a columnar shape, respectively. Also, the closed space is formed inside the plasma generating vessel, and the concave reflection portion is formed at the front side of the main body.

Thus, it makes it possible to employ ceramics or metal other than quartz glass for the main body, the light exit window, and the light entrance window, all of which constitute the laser driven lamp. For this reason, even when being irradiated with the high power ultra violet light or high power vacuum ultra violet light from the plasma, it makes it possible to prevent the distortion caused by the ultra violet light or the vacuum ultra violet light from occurring in the laser driven lamp. As a result, it makes it possible to achieve the laser driven lamp with sufficiently higher output power and longer operational life.

In addition, by providing the pressure relief part, the pressure relief part is intentionally damaged even when inside the closed space becomes under an exceptionally high pressure condition. For this reason, it makes it possible to relieve the high pressure at the prescribed position, which is specified in advance. As a result, it makes it possible to prevent other components or optical instruments from being damaged.

Yet furthermore, by providing the light incident surface of the light entrance window to be inclined with respect to the optical path of the laser beam from the laser beam generator, it makes it possible to prevent the laser beam (light) reflected by the light entrance window from returning back to and damaging the laser beam generator.

Although specific embodiments are described above, these embodiments are merely illustrative in nature and are not intended to limit the scope of the present invention. The apparatuses and the methods described in the present specification can be implemented in embodiments aside from those described above. Omissions, substitutions, and modifications can be made, as appropriate, to the embodiments described above without departing from the scope of the present invention. An embodiment with such omissions, substitutions, and modifications is encompassed by what is described in the claims and any equivalent thereof and falls within the technical scope of the present invention.

REFERENCE SIGNS LIST

1: Laser Driven Lamp
2: Main Body
2*a*: Main Body Base Part
2*b*: Reflecting Portion Forming Part
3: Light Exit Window
3*a*: Laser Beam Reflective Part
4: Light Entrance Window
5 Concave Reflection Portion
6: Laser Light Passing Hole
6*a*: Tapered Part
10: Ring Member
11: Window Attaching Cylindrical Body
12: Metallic Block
13: Window Attaching Cylindrical Body
14: Gap
15: Gas Release Pipe
16: Getter Accommodating Space
18: Ring Member
19: Communicating Hole
20: Pressure Relief Part
21: Condenser Lens
22: Laser Beam Generator
L: Laser Beam
LA: Optical Axis
RL: Reflected Laser Beam
X: Rotation Center Axis of Concave Reflection Portion
F: Focal Point
S: Closed Space

What is claimed is:

1. A laser driven lamp configured to enclose light emitting gas, receive a converging laser beam and generate plasma from the laser beam, the laser driven lamp comprising:

a main body having a columnar shape;

a concave reflecting portion formed at a front side of the main body, the concave reflecting portion having a focal point at which the laser beam converges;

a light exit window provided in front of the concave reflecting portion;

a laser beam passing hole formed at a center of the main body, the laser beam passing hole penetrating the main body in an optical axial direction of the lamp;

a light entrance window provided at a rear side of the main body, the laser beam being incident to the light entrance window; and a tapered part at a light incident side of the laser beam passing hole in the main body, the main body, the light exit window and the light entrance window constituting in combination a closed space, and the light emitting gas being enclosed in the closed space.

2. The laser driven lamp according to claim 1, further comprising a reflective part formed at a center of the light exit window and configured to reflect the laser beam.

3. The laser driven lamp according to claim 1, further comprising a gas release pipe attached to the lamp, the gas release pipe communicating with the closed space in the main body.

4. The laser driven lamp according to claim 3, further comprising a window attaching cylindrical body being made from a metal, wherein the window attaching cylindrical body attaches the light entrance window and the light exit window to the main body, respectively, and the gas release pipe being attached to the window attaching cylindrical body.

5. The laser driven lamp according to claim 3, wherein the main body is made of ceramic, and the gas release pipe is attached to the main body.

6. The laser driven lamp according to claim 3, wherein the light entrance window is attached to the main body with a metallic block being interposed between the light entrance window and the main body, and the gas release pipe is attached to the metallic block.

7. The laser driven lamp according to claim 1, wherein a laser light incidence plane surface of the light entrance window is inclined with respect to an optical path of the laser beam.

* * * * *